US009415492B2

(12) United States Patent
Graber

(10) Patent No.: US 9,415,492 B2
(45) Date of Patent: Aug. 16, 2016

(54) PNEUMATIC COMPRESSOR ASSEMBLY AND METHOD OF REPAIRING A TRANSMISSION

(71) Applicant: Jeffery Shawn Graber, Goshen, IN (US)

(72) Inventor: Jeffery Shawn Graber, Goshen, IN (US)

( * ) Notice: Subject to any disclaimer, the term of this patent is extended or adjusted under 35 U.S.C. 154(b) by 110 days.

(21) Appl. No.: 14/251,865

(22) Filed: Apr. 14, 2014

(65) Prior Publication Data

US 2014/0317901 A1 Oct. 30, 2014

Related U.S. Application Data

(60) Provisional application No. 61/815,870, filed on Apr. 25, 2013.

(51) Int. Cl.
*B25B 27/30* (2006.01)

(52) U.S. Cl.
CPC ..... *B25B 27/304* (2013.01); *Y10T 29/49718* (2015.01); *Y10T 29/53617* (2015.01)

(58) Field of Classification Search
CPC .... B25B 27/026; B25B 27/064; B25B 27/12; B25B 27/14
See application file for complete search history.

(56) References Cited

U.S. PATENT DOCUMENTS 3,359,618 A * 12/1967 Murphy ..... B23P 19/02 100/214
4,205,421 A 6/1980 Martinez-Machin
4,544,134 A * 10/1985 Mitchell ..... B66F 3/24 254/133 R
4,763,394 A * 8/1988 Decato ..... B23P 19/02 29/252
4,989,310 A * 2/1991 Choat ..... B25B 27/026 29/252
5,174,004 A * 12/1992 King ..... B21D 39/02 269/155
5,860,203 A * 1/1999 Gehr, Jr. ..... B23P 19/025 29/252
5,983,475 A 11/1999 Umling
6,131,261 A * 10/2000 Michlin ..... B23P 19/02 29/251
6,247,216 B1 * 6/2001 Rader, Jr. ..... B25B 27/064 29/252
2014/0317901 A1 * 10/2014 Graber ..... B25B 27/304 29/402.01

* cited by examiner

*Primary Examiner* — Lee D Wilson
(74) *Attorney, Agent, or Firm* — King & Schickli, PLLC

(57) ABSTRACT

A pneumatic compressor assembly includes a frame and an actuator carried on the frame. The actuator includes a cylinder and a piston. A tool is secured to the end of the piston. The tool includes a cross rail and two sets of adjustable compression fingers.

25 Claims, 8 Drawing Sheets

PNEUMATIC COMPRESSOR ASSEMBLY AND METHOD OF REPAIRING A TRANSMISSION

This utility patent application claims the benefit of priority in U.S. Provisional Patent Application Ser. No. 61/815,870 filed on Apr. 25, 2013, the entirety of the disclosure of which is incorporated herein by reference.

TECHNICAL FIELD

This document relates generally to the field of repair tools and more particularly to a pneumatic compressor assembly and method for repairing a vehicle transmission.

BACKGROUND

With the ever increasing price of new automobiles and trucks, more and more consumers are choosing to drive their vehicles for a longer time before trading them in on a new or newer used vehicle. As a consequence, more and more vehicles are undergoing transmission repair to keep them operating properly and on the road.

This document relates to a new compressor assembly and related method to quickly and conveniently remove and replace the return spring assembly from a transmission. Advantageously, the compressor assembly and method substantially reduce the repair time necessary to complete this operation. In fact, use of the compressor assembly and method may save the mechanic, on average, between 15 and 20 minutes when completing the transmission repair.

SUMMARY

In accordance with the purposes and benefits described herein, a compressor assembly comprises a frame, an actuator carried on the frame and a tool secured to the distal end of the actuator. In one embodiment the actuator is a pneumatic actuator including a cylinder and a piston. Further the assembly includes a pressurized air source and a control valve for operating a pneumatic actuator. The tool may include a cross rail, a first set of adjustable spring compression fingers and a second set of adjustable spring compression fingers. The first and second sets of spring compression fingers are carried on the cross rail.

In addition the assembly may include a ram having a first end connected to the piston of the actuator and a second end connected to the tool. The ram may include multiple segments that are connected together in different ways to allow length adjustment.

In accordance with another aspect, a method of repairing a transmission is provided. That method may be broadly described as comprising the steps of: (a) engaging and compressing a return spring assembly of the transmission clutch with a pneumatically operated compression assembly, (b) removing a retaining ring of the transmission clutch return spring assembly while the return spring assembly is compressed to allow removal of the return spring assembly and disassembly of the transmission for needed repairs. The method may further include compressing the return spring assembly quickly, efficiently and in a controlled manner by engaging the control lever with a single hand.

In accordance with yet another aspect, a method is provided for repairing a transmission using a compressor assembly including an actuator, a ram and a tool secured to the end of the ram. That method comprises the steps of: (a) adjusting the compressor assembly to match a depth of a housing of the transmission to be repaired, (b) engaging and compressing a return spring assembly of the transmission with the tool, (c) removing the retaining ring while the return spring assembly is compressed and (d) releasing and removing the return spring assembly from the transmission. The method may also include connecting multiple segments together to provide a ram of desired length. Further the method includes the steps of reseating the return spring assembly in the transmission, engaging and pressing the return spring assembly with the tool, securing the retaining ring in position to hold the return spring assembly in the transmission and releasing the tool from engagement with the return ring assembly in order to complete the operation.

In the following description, there is shown and described several preferred embodiments of the compressor assembly and transmission repair method. As it should be realized, they are capable of other, different embodiments and their several details are capable of modification in various, obvious aspects all without departing from the assembly and method as set forth and described in the following claims. Accordingly, the drawings and descriptions should be regarded as illustrative in nature and not as restrictive.

BRIEF DESCRIPTION OF THE PHOTOGRAPHS

DETAILED DESCRIPTION

Figure 1:
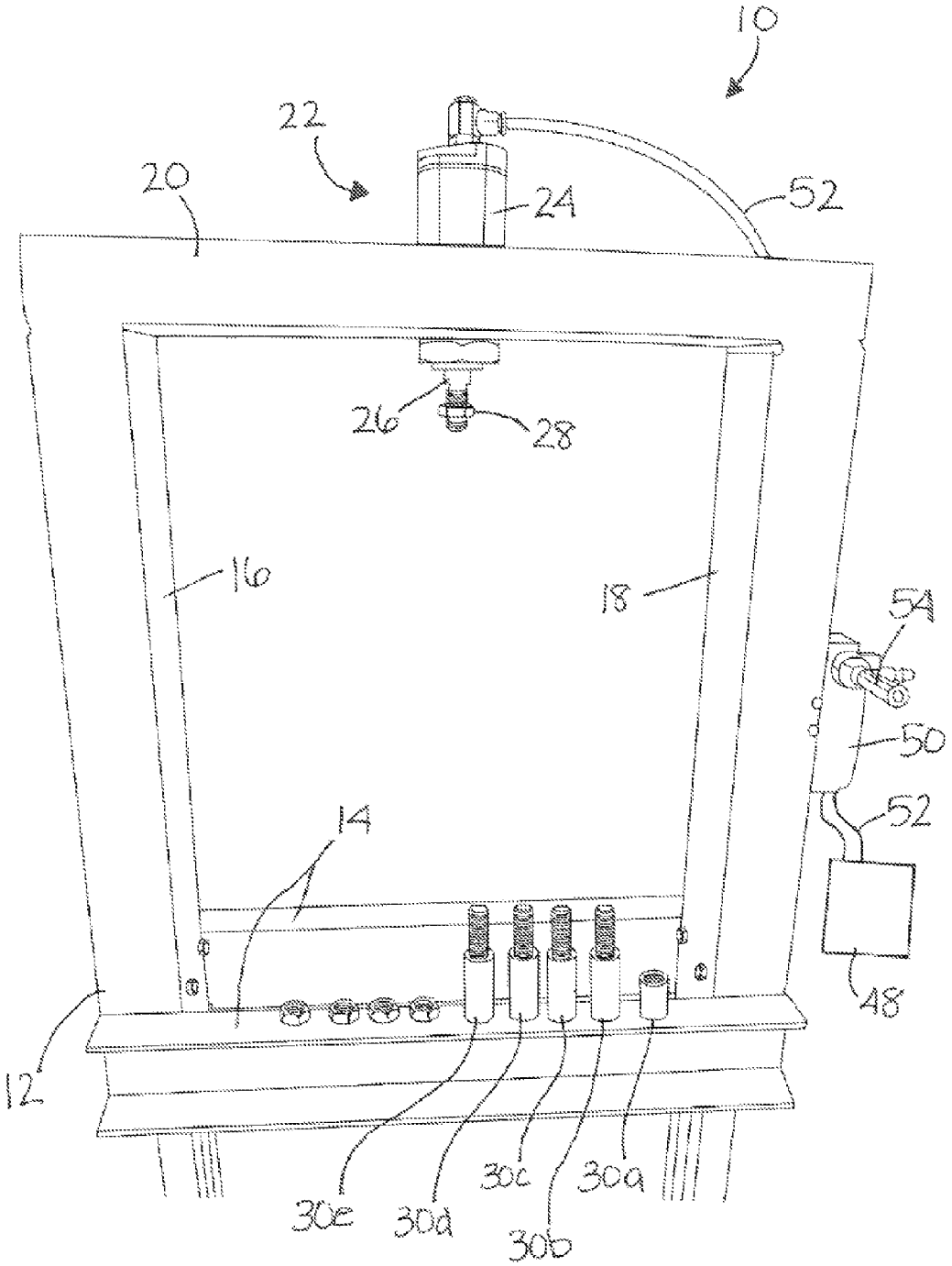
FIG. 1 is a perspective view of the pneumatic compressor assembly or device.
Figure 2:
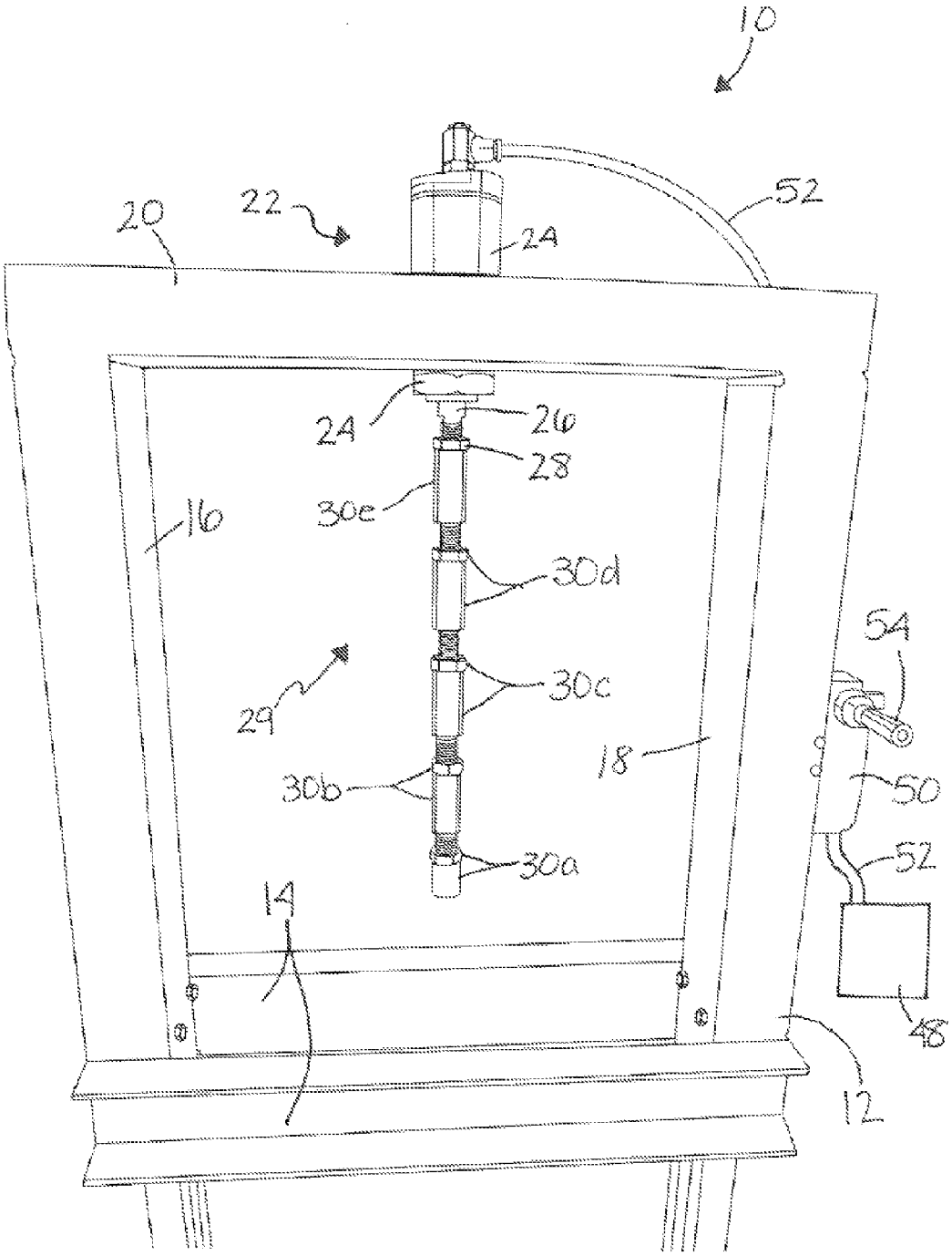
FIG. 2 is a view similar to FIG. 1 but showing all five ram segments secured to the threaded end or fastener at the end of the piston of the pneumatic actuator.
Figure 3:
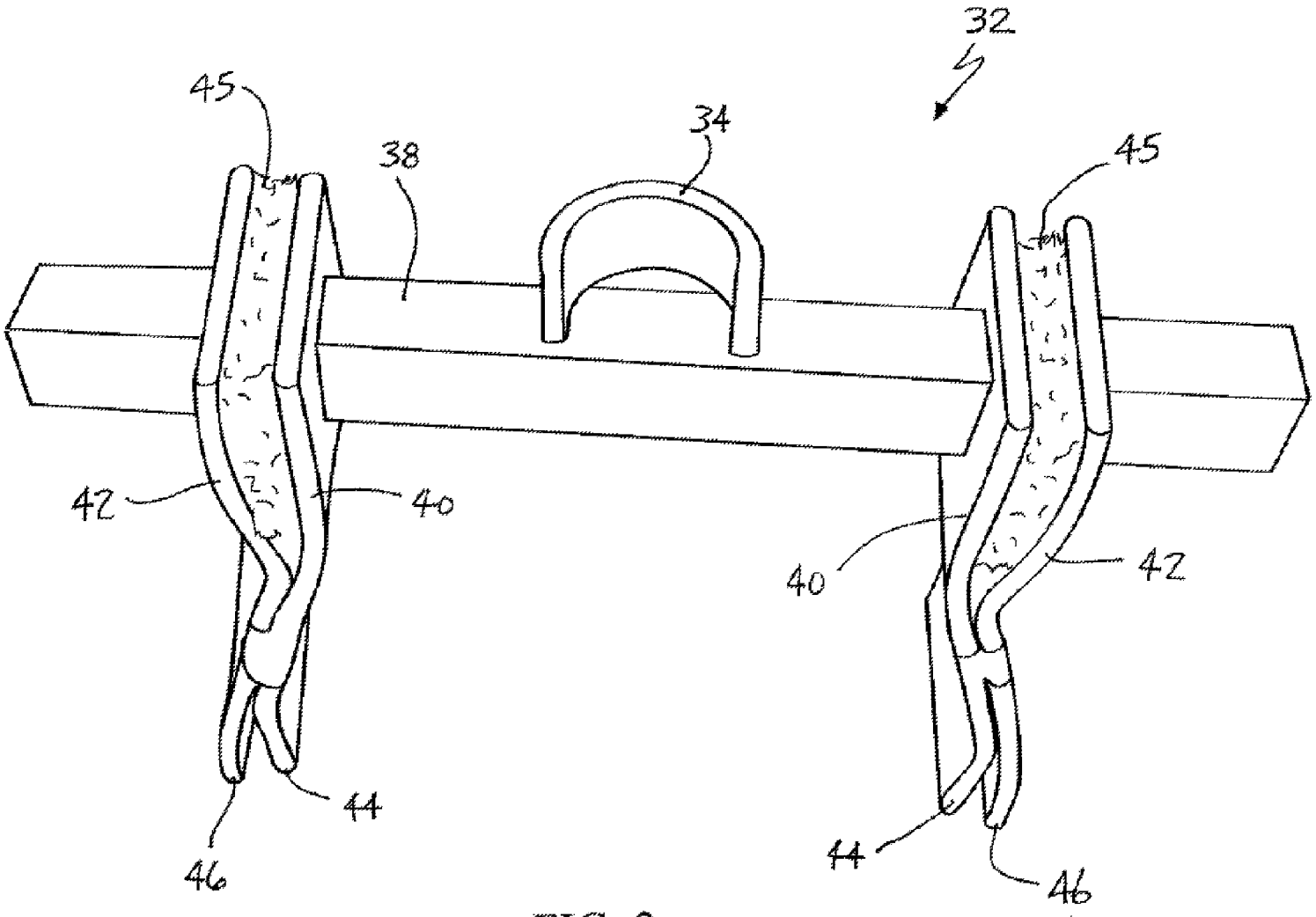
FIG. 3 is a detailed perspective view of the tool.

As illustrated in FIGS. 1-3, a pneumatic compressor assembly 10 includes a frame 12 having a base 14, a first upright 16, a second upright 18 and a crossbar 20. The frame 12 is made from a high strength material such as steel. The various members of the frame 12 including the base 14, first upright 16, second upright 18 and crossbar 20 may be welded or otherwise secured together as desired.

A pneumatic actuator 22 is secured to the crossbar 20. The pneumatic actuator 22 is of a type known in the art including a cylinder 24 and a reciprocating piston 26. Such an actuator 22 may, for example, have a 5.08 cm bore and a 7.62 cm stroke. In another embodiment, the actuator 22 may have a bore of 5.08 cm and a stroke of 2.54 cm. The piston 26 extends through an opening (not shown) in the crossbar 20 and is pointed toward the base 14. The end of the piston 26 is threaded or includes a fastener 28 for receiving and holding a ram 29 made from a series of ram segments **30*a*-30*e* (including cooperating fastening/jam nuts). In the illustrated embodiment, the ram segments 30*a*-30*e* are secured together in series by cooperating screw threads. As should be appreciated, each ram segment 30*a*-30*e* may be of the same or different lengths. Two or more of the ram segments 30*a*-30*e*** are connected together to form a ram 29 of desired length to allow the user to service different depth transmission housings (e.g. ram lengths of two inches, four inches, six inches, eight inches and ten inches). The operator simply fastens or secures the appropriate ram segment 30*a*-30*e* to the distal end of the piston 26.

A tool 32 is secured to the distal end of the ram 29 by any appropriate means including, for example, an arcuate retainer 34. As best illustrated in FIG. 3, the arcuate retainer 34 is received around the distal end of the ram 29 and provides a friction fit. The tool 32 further includes a cross rail 38 that receives and holds first and second sets of adjustable spring compression fingers 40, 42. Each set of spring compression fingers 40, 42 comprises two spaced compression tips 44, 46. As should be appreciated, the fingers 40, 42 are curved and secured together by a welding or brazing 47 in order to hold the tips 44, 46 in the desired spaced orientation. A felt material 45 is provided between the fingers 40, 42 at an end opposite the tips 44, 46 in order to add drag to the fingers to help keep them in place while pressing.

As should be appreciated, the outer finger 42 is slightly longer then the inner finger 40 for each set of fingers. This allows the compression fingers 40, 42 to be quickly and conveniently adjusted to the proper size to engage the spring assembly S of a transmission T. More specifically, one slides the first and second set of fingers 40, 42 inwardly along the cross rail 38 until the tips 46 engage the side of the spring assembly S. The longer outer tips 46 engage the side of the spring assembly S and hold the inner tips 44 in perfect position to engage and hold the spring assembly S in a retracted position.

The pneumatic actuator 22 is operatively connected to a pressurized air source 48 and a control valve 50 by means of pressurized airlines 52. The operator has fingertip control of the compressor assembly 10 by engaging the control valve operating lever 54. By pushing the lever downwardly, pressurized air from the pressurized air source 48 forces the piston 26 against a return spring (not shown) to extend from the cylinder 24 downwardly toward the base 14 of the frame 12. By manipulating the control lever 54 in the opposite direction, pressurized air from the pressurized air source 48 is released and the return spring forces the piston 26 to be retracted into the cylinder 24 and thereby move away from the base 14.

Figure 4:
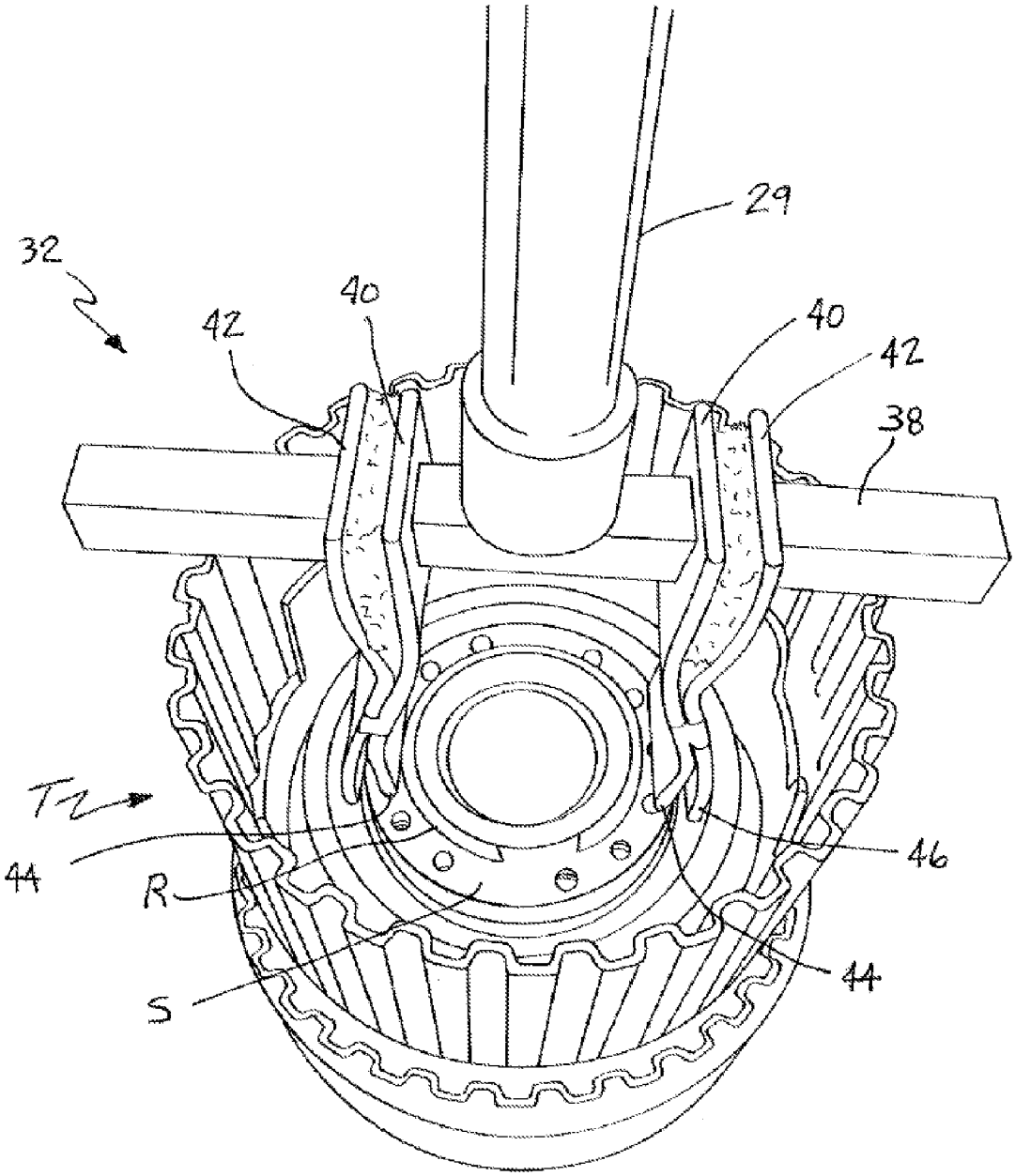
FIG. 4 illustrates the step of compressing a return spring assembly of a transmission with the aligned compression fingers of the tool.

While also useful for other applications, the pneumatic compressor assembly 10 allows one to quickly and efficiently repair a transmission T. See particularly FIGS. 4-8. First the operator determines the depth of the housing H of the transmission T undergoing repair. He then selects the appropriate length of ram 29 and constructs it by joining two or more of the ram segments 30*a*-30*e* together. The ram 29 is then connected to the end of the piston 26 by means of the fastener 28. The tool 32 is then connected to the end of the ram and the transmission T to be repaired is supported on the base 14 of the frame 12 underneath the pneumatic actuator 22. The first and second spring compression fingers 40, 42 are then moved inwardly or outwardly along the cross rail 38 to bring the compression tips 44, 46 into proper alignment for compressing the return spring assembly S of the transmission T. The operator then uses a single hand to manipulate the control valve operating lever 54 so as to extend the piston 26 from the cylinder 24 downwardly and compress the return spring assembly S (see FIG. 4). The assembly 10 provides precise control so that the spring assembly S may be compressed just enough to remove the retaining ring R without damaging any transmission components. In one possible embodiment, the actuator 22 only provides for limited travel or extension of about 2.54 cm. This allows the actuator 22 to compress the spring assembly S sufficiently to remove the retaining ring R without distorting any of the springs or damaging the housing.

Figure 5:
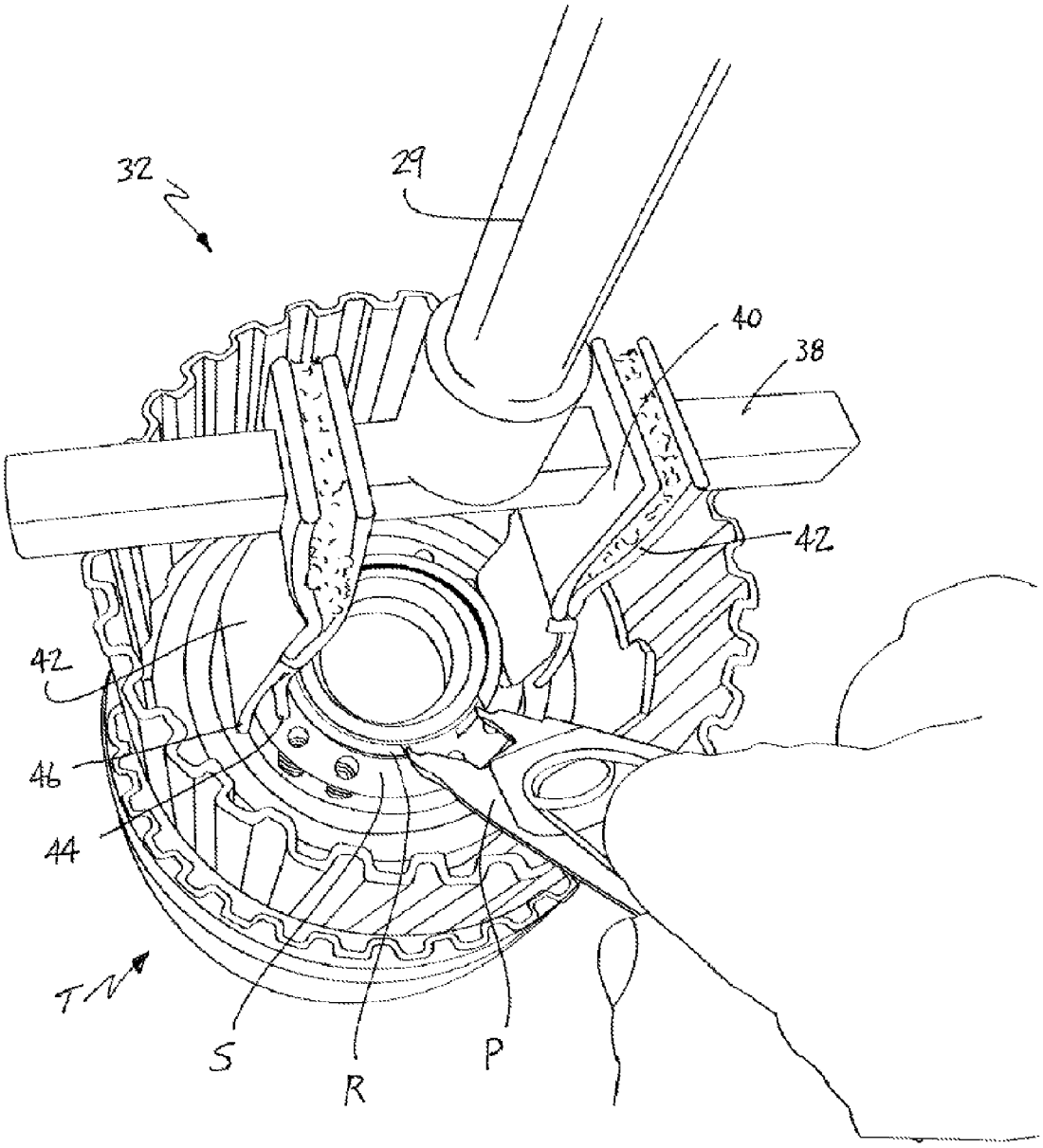
FIG. 5 illustrates the step of removing the retaining ring while the return spring assembly is compressed.
Figure 6:
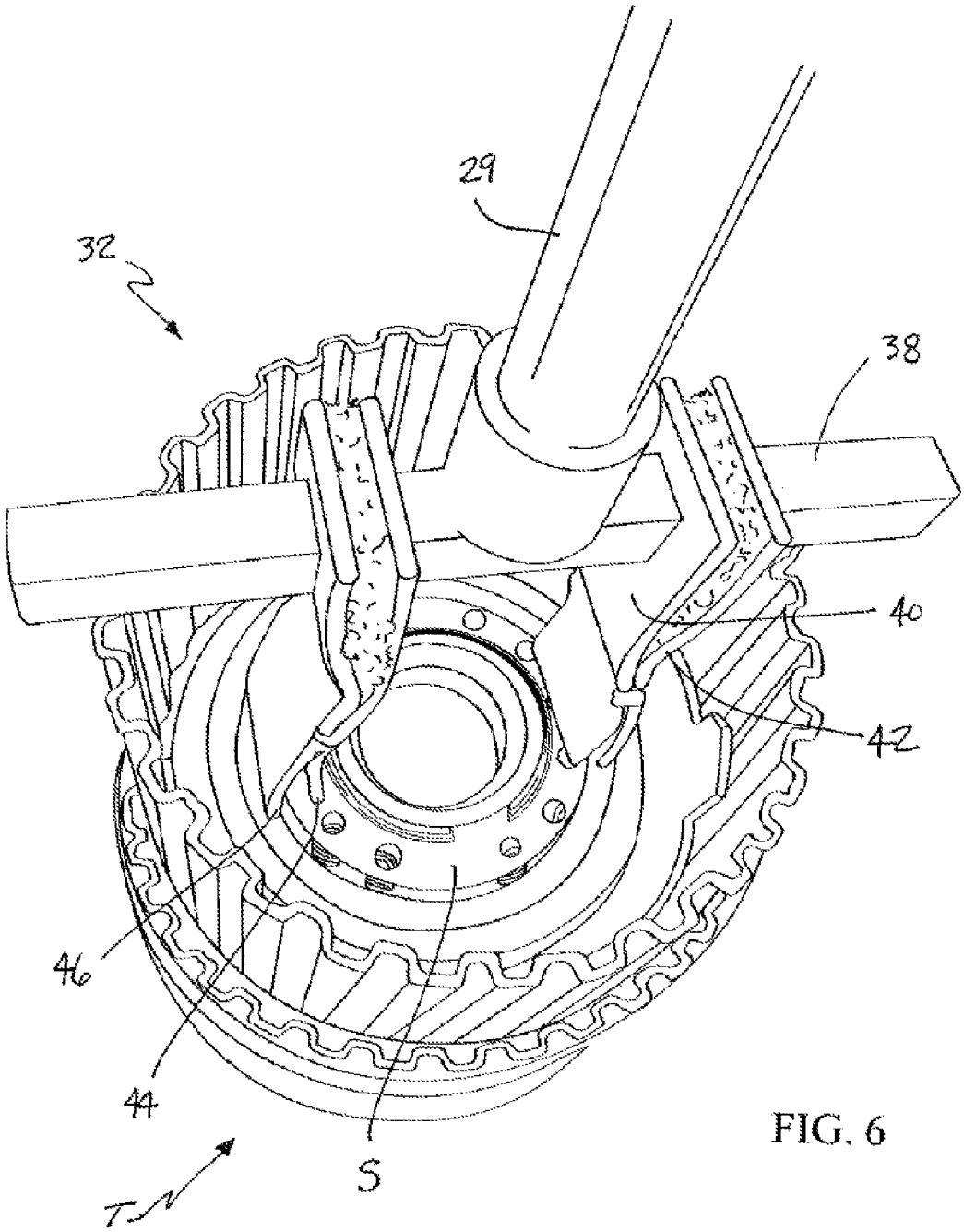
FIG. 6 illustrates the return spring assembly following removal of the retaining ring.
Figure 7:
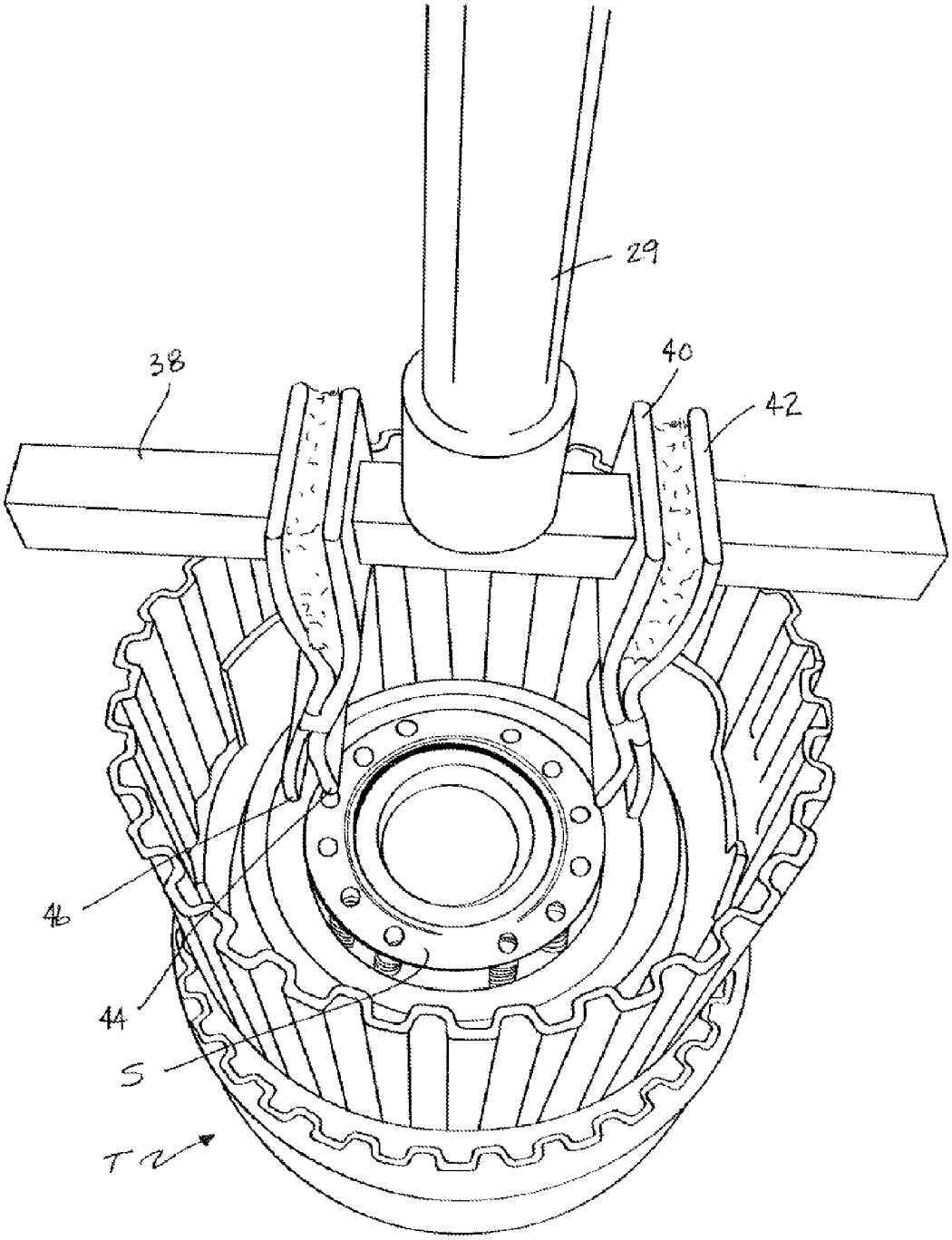
FIG. 7 illustrates the return spring assembly after the compression fingers have been retracted.

With the return spring assembly S held in a state of compression by the pneumatic actuator 22 through engagement with the compression fingers 40, 42, the retaining ring R is removed using lock ring pliers P (see FIGS. 5 and 6). The operator then again uses a single hand to manipulate the control valve operating lever 54 and retract the piston 26 into the cylinder 24 until the compression fingers, 40, 42 are free of the transmission T. As this is done the return spring assembly S is gently released and can then be removed to complete transmission repairs (see FIGS. 7 and 8).

Following the completion of repairs, the return spring assembly S is placed in its seating position in the transmission T. The return spring assembly S is then again compressed by operation of the assembly 10 so that one can secure the retaining ring R in position with the lock ring pliers P. The lever 54 is then manipulated to gently release the compressor fingers 40, 42 from engagement with the return spring assembly S.

The foregoing has been presented for purposes of illustration and description. It is not intended to be exhaustive or to limit the embodiments to the precise form disclosed. Obvious modifications and variations are possible in light of the above teachings. For example instead of utilizing multiple ram segments 30*a*-30*e* to provide for ram length adjustment to match the depth of the transmission housing, an adjustable frame 12 could be provided.

Figure 8:
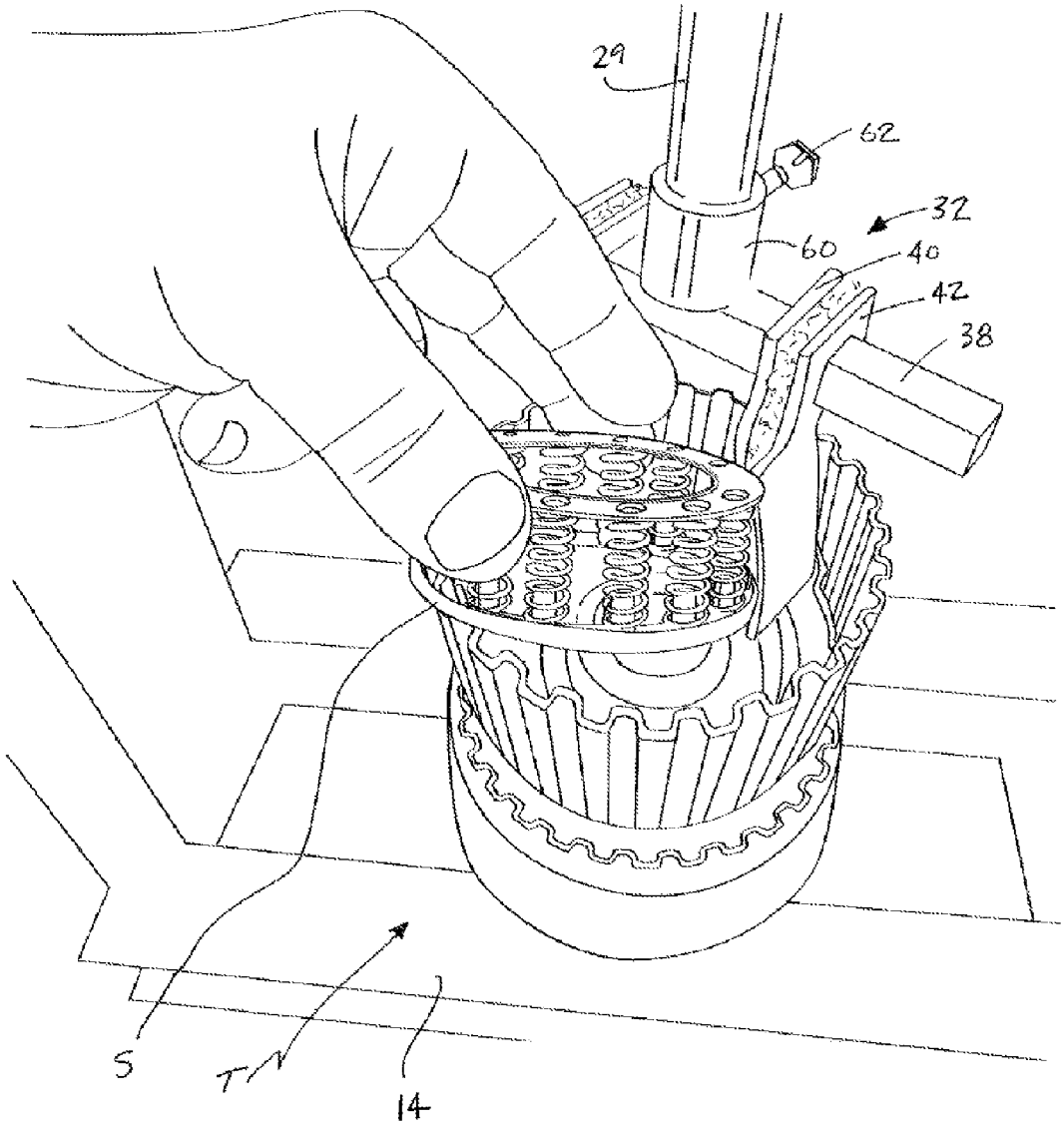
FIG. 8 illustrates the removal of the return spring assembly from the transmission.

As another example, instead of the arcuate retainer 34 (which functions to center the tool 32 on the ram 29 while allowing one to slide the tool off the ram when desired), the tool 32 may be attached to the ram by means of a mounting collar 60 and cooperating bolt 62 (see FIG. 8 embodiment). All such modifications and variations are within the scope of the appended claims when interpreted in accordance with the breadth to which they are fairly, legally and equitably entitled.

What is claimed:

1. A compressor assembly, comprising:

a frame;

an actuator carried on said frame, wherein said actuator is a pneumatic actuator including a cylinder and a piston;

a control valve for operating the pneumatic actuator;

a pressurized air source; and a tool secured to a distal end of said actuator, said tool including a cross rail, a first set of adjustable spring compression fingers and a second set of adjustable spring compression fingers, where said first and second set of spring compression fingers are carried on said cross rail.

2. The assembly of claim 1, further including a ram having a first end connected to said piston of said actuator and a second end connected to said tool.

3. The assembly of claim 2, wherein said ram includes multiple segments that may be connected together to allow length adjustment.

4. A compressor assembly, comprising:

a frame;

an actuator carried on said frame;

a tool secured to a distal end of said actuator, wherein said tool includes a cross rail, a first set of adjustable spring compression fingers and a second set of adjustable spring compression fingers where said first and second set of spring compression fingers are carried on said cross rail.

5. The assembly of claim 4, wherein said actuator is a pneumatic actuator including a cylinder and a piston.

6. The assembly of claim 5 further including a control valve for operating said pneumatic actuator.

7. The assembly of claim 6, further including a pressurized air source.

8. The assembly of claim 5, further including a ram having a first end connected to said piston of said actuator and a second end connected to said tool.

9. The assembly of claim 8, wherein said ram includes multiple segments that may be connected together to allow length adjustment.

10. A compressor assembly, comprising:

a frame;

an actuator carried on said frame, wherein said actuator is a pneumatic actuator including a cylinder and a piston;

a ram having a first end connected to said piston of said actuator and a second end connected to said tool, wherein said ram includes multiple segments that may be connected together to allow length adjustment; and a tool secured to a distal end of said actuator.

11. The assembly of claim 10 further including a control valve for operating said pneumatic actuator.

12. The assembly of claim 11, further including a pressurized air source.

13. The assembly of claim 12, wherein said tool includes a cross rail.

14. The assembly of claim 13, wherein said tool further includes a first set of adjustable spring compression fingers and a second set of adjustable spring compression fingers where said first and second set of spring compression fingers are carried on said cross rail.

15. The assembly of claim 10, wherein said tool includes a cross rail.

16. The assembly of claim 15, wherein said tool further includes a first set of adjustable spring compression fingers and a second set of adjustable spring compression fingers where said first and second set of spring compression fingers are carried on said cross rail.

17. The assembly of claim 10, wherein said tool includes a cross rail, a first set of adjustable spring compression fingers and a second set of adjustable spring compression fingers.

18. A compressor assembly, comprising:

a frame;

an actuator carried on said frame;

a tool secured to a distal end of said actuator, wherein said tool includes a cross rail, a first set of adjustable spring compression fingers and a second set of adjustable spring compression fingers.

19. The assembly of claim 18, wherein said actuator is a pneumatic actuator including a cylinder and a piston.

20. The assembly of claim 19 further including a control valve for operating said pneumatic actuator.

21. The assembly of claim 20, further including a pressurized air source.

22. The assembly of claim 21, wherein said first and second set of spring compression fingers are carried on said cross rail.

23. The assembly of claim 19, further including a ram having a first end connected to said piston of said actuator and a second end connected to said tool.

24. The assembly of claim 23, wherein said ram includes multiple segments that may be connected together to allow length adjustment.

25. The assembly of claim 18, wherein said first and second set of spring compression fingers are carried on said cross rail.

* * * * *